United States Patent [19]

Yamaguchi

[11] Patent Number: 4,723,428

[45] Date of Patent: Feb. 9, 1988

[54] CYLINDER LOCK WITH COVER

[75] Inventor: Noboru Yamaguchi, Aichi, Japan

[73] Assignee: Kabushiki Kaisha Tokai Rika Denki Seisakusho, Aichi, Japan

[21] Appl. No.: 872,656

[22] Filed: Jun. 10, 1986

[30] Foreign Application Priority Data

Jun. 24, 1985 [JP] Japan ..... 60-95368[U]

[51] Int. Cl.[4] ..... E05B 17/18

[52] U.S. Cl. ..... 70/455; 70/423; 70/427

[58] Field of Search ..... 70/423, 427, 455

[56] References Cited

U.S. PATENT DOCUMENTS

| | | | |
|---|---|---|---|
| 1,811,141 | 6/1931 | Leventhal | 70/455 |
| 2,213,814 | 9/1940 | Jacobi . | |
| 2,355,300 | 8/1944 | Johnstone | 70/455 |
| 2,602,319 | 7/1952 | Jacobi | 70/455 |
| 2,702,468 | 2/1955 | Spain | 70/455 |
| 3,564,880 | 2/1971 | Kwasiborski | 70/455 X |
| 3,898,824 | 8/1975 | Borlinghaus . | |
| 3,930,391 | 1/1976 | Borlinghaus . | |
| 4,192,161 | 3/1980 | Borlinghaus . | |
| 4,586,355 | 5/1986 | Lee et al. | 70/455 |
| 4,597,274 | 7/1986 | Coscia et al. | 70/455 |

FOREIGN PATENT DOCUMENTS 59-122354 2/1959 Japan .

*Primary Examiner*—Robert L. Wolfe
*Assistant Examiner*—Suzanne L. Dino
*Attorney, Agent, or Firm*—Finnegan, Henderson, Farabow, Garrett and Dunner

[57] ABSTRACT

A cylinder lock with a cover that is held open with first and second engaging members during the time that a key is inserted in the lock. The lock further includes a mechanism for disabling the operation of a remote lock release device upon rotation in a predetermined direction of a key in the lock.

1 Claim, 9 Drawing Figures

CYLINDER LOCK WITH COVER

FIELD OF THE INVENTION

This invention relates to a cylinder lock with a cover which is used, for instance, for the trunk of an automobile.

BACKGROUND OF THE INVENTION

One example of a cylinder lock provided for the trunk of an automobile is designed as follows. The lock is provided with a cover to open and close the front surface of the key rotor. Engaging parts are formed respectively on the cover and the lock body to maintain the cover open. The cover is urged by a spring so that it is normally closed.

The conventional cylinder lock with the cover is provided with the engaging parts to maintain the cover open during the key operation as was described above. However, the cylinder lock is disadvantageous in that the cover is not automatically returned to its original position; that is, in order to return the cover to the original position it is necessary to manually disengage the engaging parts from each other, and the operator often forgets to close the cover. In order to eliminate this disadvantage, the instant inventor has proposed a cylinder lock with a cover that is designed to remain open while a key that has been inserted into the key rotor is turned for unlocking. The cover is automatically closed upon removal of the key from the key rotor. This is described in Japanese Unexamined Utility Model Application No. 122354/84.

Recently, a trunk opener means has been employed in combination with a cylinder lock so that the trunk can be released without using the key. This is normally done by operating a lever provided near the operator's seat. While this is convenient it has the disadvantage that if the car doors are not locked, the trunk can be opened without using the key. Therefore, there is an increased risk that the things in the trunk may be stolen. Furthermore in the case where the automobile is loaned to another person, or the engine key is given to another person, for instance at a parking area, the trunk can be readily opened.

In order to overcome the above-described difficulties, a cancelling mechanism has been proposed that is designed so that if a key inserted into the key rotor of the trunk is turned through a predetermined angle in a direction opposite to the direction of unlocking, then it becomes impossible to open the trunk even if the lever is operated at the operator's seat. The cancelling mechanism is applied to an ordinary trunk cylinder lock that has no cover. However, since the present invention relates to a cylinder lock with a cover and is not based on the technical concept that the key is turned in the direction opposite to the direction of unlocking, it is impossible to combine the cylinder lock hereof with the cancelling mechanism previously known.

OBJECTS AND SUMMARY OF THE INVENTION

An object of the present invention is an improved, more secure cylinder lock particularly adapted for use with motor vehicle.

Another object of the present invention is a cylinder lock having a cover that is held open during manipulation of the lock and automatically closes thereafter.

A further object of the present invention is a cylinder lock capable of disengaging a remote unlocking device.

These and other objects are achieved by a cylinder lock comprising a body including a key rotor, a cover rotatable along the front surface of the body and rotatable between open and closed positions to respectively uncover and cover the front side of the key rotor, a spring for urging the cover to the closed position, a first engaging protrusion formed on the body and a second engaging protrusion formed on the cover so that when the cover is in the open position the first and second engaging protrusions engage each other to maintain the cover in the open position against the force of the spring, a movable part movably provided on the front side of the key rotor, the movement of the movable part being prevented by insertion of a key, a lock lever movably provided on the body, the movement of the lock lever being prevented when movement of the movable part is prevented, a releasing member adapted to move the cover to the open position and away from the front surface of the body to disengage the first and second engaging protrusions from each other when a key inserted in the key rotor is turned in a predetermined direction, and a lock element formed on the cover, the lock element engaging the lock lever when the first and second engaging protrusions are disengaged from each other by the releasing member, to prevent movement of the lock lever by the movable part until the key is removed to permit movement of the movable part.

BRIEF DESCRIPTION OF THE DRAWINGS

The manner by which the above objects and other objects, features, and advantages of the present invention are attained will become fully apparent from the following detailed description when it is considered in view of the drawings, wherein.

DETAILED DESCRIPTION OF THE PREFERRED EMBODIMENT

Figure 1:
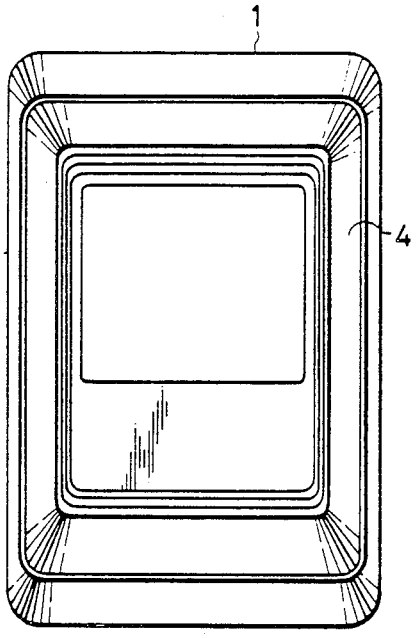
FIG. 1 is a front view of the cylinder lock of the present invention.

One embodiment of the present invention will be described with reference to the accompanying drawings. In these drawings, a lock body 1 includes a cylinder 3 having a rotor insertion hole 2 formed integrally with the lock body and extending rearwardly of the latter. The lock body 1 is fixed to the trunk lid of an automobile. A rectangular cover 4 is provided which is substantially equal in size to the body 1. The cover 4 has a shaft 5 protruding from its rear side. The shaft 5 is rotatably inserted into a hole 6 formed in the body 1, and a washer 7 is fixedly mounted on the end portion of the shaft 5 so that the cover 4 is rotatably supported on the front side of the body 1.

A spring 8 is wound on the shaft 5. The spring 8 elastically urges the cover 4 through the washer 7 towards the front side of the body 1, while both bent ends 8*a* and 8*b* of the spring 8 are engaged with a hooking protrusion 1*a* provided on the rear side of the body 1 and a hooking protrusion 7*a* of the washer 7, respectively, so that the cover 4 is urged in the direction of the arrow A; that is, in the direction of closing.

An engaging protrusion 9 is formed on the rear side of the cover 4. The engaging protrusion 9 is in the form on an arc centered about the shaft 5. A cylindrical lock element 10 extends near an end portion 9*a* of the engaging protrusion. A stepped stopper 11 is formed on the rear side of the cover 4.

Figure 6:
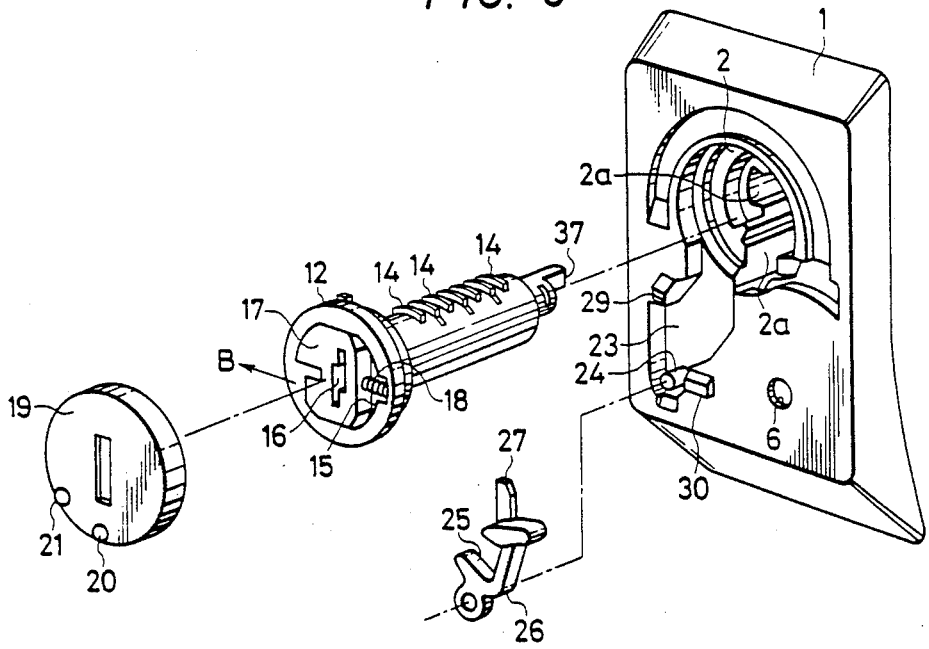
FIG. 6 is a partial, exploded, perspective view of the cylinder lock of FIG. 1.

A key rotor 12 (FIG. 6) is rotatably inserted into the rotor inserting hole 2. The key rotor 12 has a plurality of lock plates 14 extending across the axis of the key rotor 12. The lock plates 14 protrude radially when a key is not inserted into a key hole 13. Under the same condition, the end portions of the lock plates 14 are engaged with one of four lock grooves 2*a* (only two shown in FIG. 6) formed in the inner wall of the rotor inserting hole 2 to prevent rotation of the key rotor 12. A recess 15 is formed in the front end face of the key rotor 12. A movable part 17 is slidably inserted in the recess 15 and is urged in the direction of the arrow B by a coil spring 18. The movable part 17 has a through-hole 16 in the form of a slit corresponding to the key hole 13 for the key rotor 12.

Figure 2:
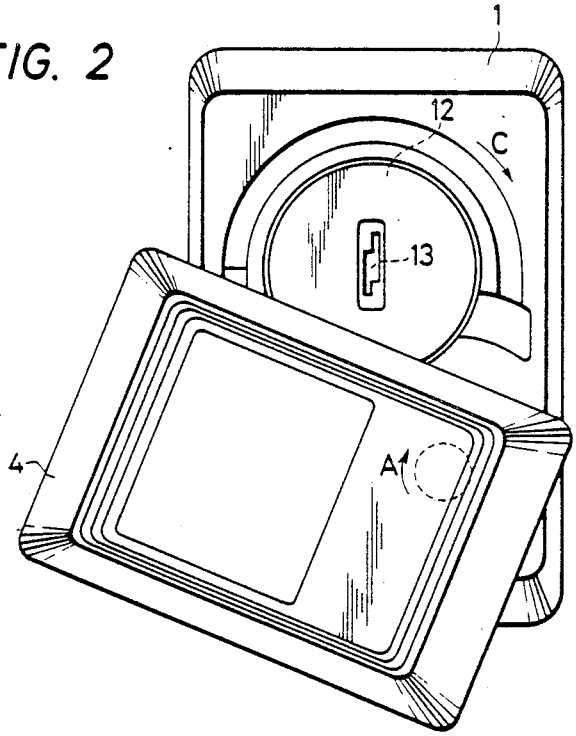
FIG. 2 is a front view of the cylinder lock of FIG. 1 with the front cover open.

A rotor cover 19 is fixed secured to the front end face to cover the recess 15. Two protrusions 20 and 21 are formed as releasing members on the periphery of the front surface of the rotor cover 19. A releasing protrusion 22 is formed on the rear side of the cover 4. The releasing protrusion 22 is positioned on the locus of rotation of the protrusions 20 and 21 when the cover 2 is turned in the direction opposite to the direction of the arrow A against the elastic force of the spring 8; that is, the cover is opened as shown in FIG. 2.

Figure 7:
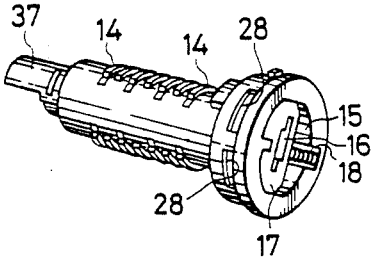
FIG. 7 is a perspective view of a key rotor of the cylinder lock of FIG. 1.

A recess 23 is formed in the front surface of the body 1 in such a manner that it merges with the rotor inserting hole 2. A shaft 24 extends from the bottom of the recess 23. A lock lever 26 with a U-shaped engaging part 25 is rotatably mounted on the shaft 24 in the recess 23. A regulating part 27 extends from an end of the lock lever 26. The regulating part 27 abuts against the outer wall of the movable part 17 through one of the slit-shaped through holes 28 formed in the outer cylindrical wall of the recess 15 as shown in FIG. 7. When the cover 4 is opened upon being turned in the direction opposite to the direction of the arrow A, the lock element 10 confronts the engaging part 25 of the lock lever 26 as indicated by the two-dot chain line in FIG. 3.

An engaging protrusion 29 is formed on the front side of the body 1 near the recess 23. The engaging protrusion 29 is engaged with the end 9*a* of the engaging protrusion 9 when the cover 4 is turned in the direction opposite to the direction of the arrow A and against the elastic force of the spring 8; that is, when the cover 4 is opened. A stopper 30 protrudes from the front side of the body 1 near the recess 23. When the cover 4 is closed as shown in FIG. 1, the protruding stopper 30 is engaged with the stepped stopper 11 of the cover 4 to prevent the rotation of the cover 4 in the direction of the arrow A. A groove 31 is formed in the front surface of the body 1. The groove 31 merges with the recess 23. When the cover 4 is closed as shown in FIG. 1, the releasing protrusion 22 abuts against the end 31*a* of the groove 31 to prevent the rotation of the cover in the direction of the arrow A.

Figure 3:
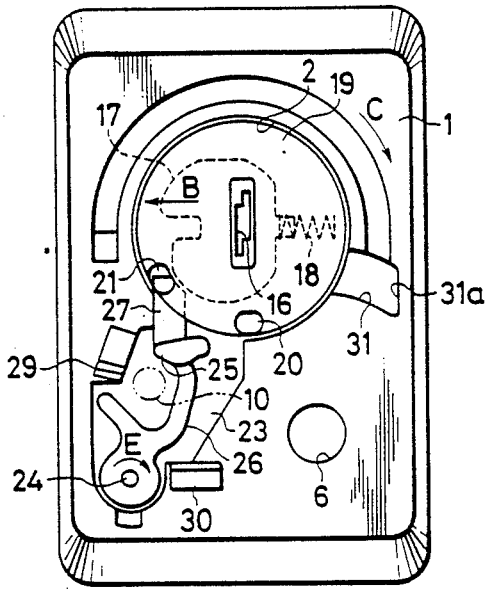
FIG. 3 is a front view of the cylinder lock of FIG. 1 with the cover removed therefrom.
Figure 4:
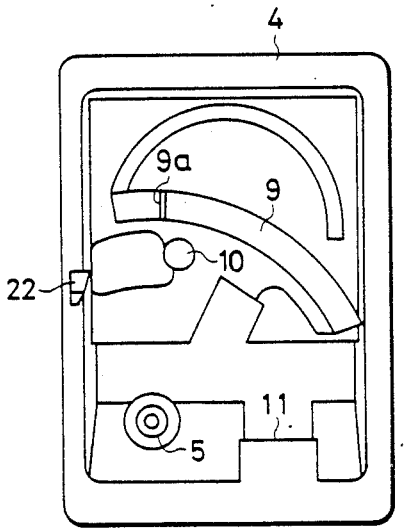
FIG. 4 is a rear view of the cover of the cylinder lock of FIG. 1.
Figure 5:
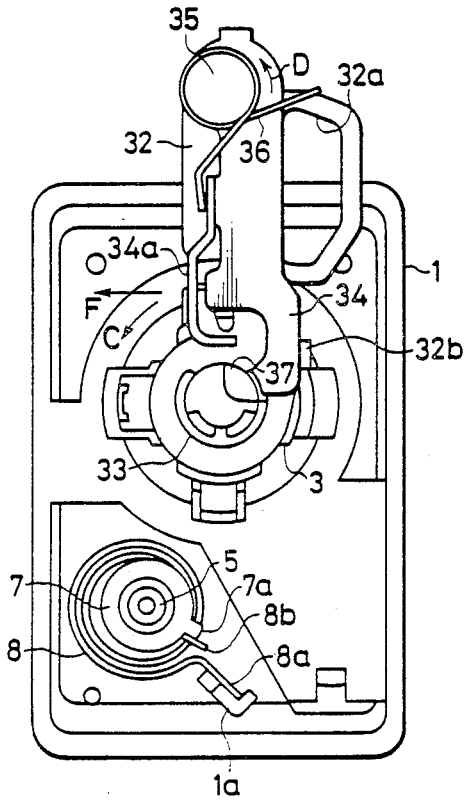
FIG. 5 is a rear view of the cylinder back of FIG. 1.

A lever 32 (FIG. 5) is coupled to the rear end portion of the key rotor 12 with an E-ring so that it will not come off the key rotor. The lever 32 has a coupling hole 32*a* to which a lever (not shown) from a trunk locking device is coupled. As the key that has been inserted into the key rotor 12 is turned in the direction of the arrow C from the locking position as shown in FIGS. 2, 3 and 5, the lever 32 is also turned in the same direction to release the trunk locking device.

Figure 9:
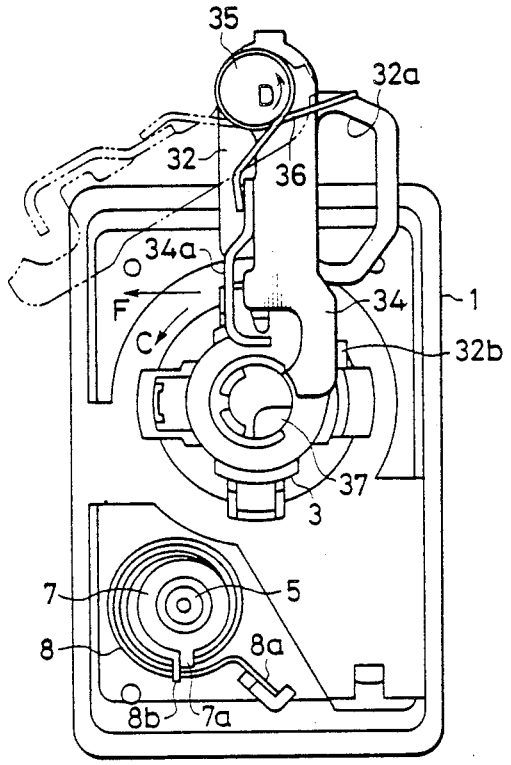
FIG. 9 is a different rear view of the cylinder lock of FIG. 1.

A trunk opener operating lever 34 is rotatably supported on the end portion of the lever 32 through a shaft 35. The lever 34 is urged in the direction of the arrow D by a coil spring 36 so that it normally abuts against the stopper 32*b* of the lever 32. An engaging protrusion 37 is formed at the end of the key rotor 12. When the key rotor 12 rotates to the locking position, the end portion of the lever 34 confronts the engaging protrusion 37 to prevent the rotation of the lever 34 in the direction of the arrow D. When the key rotor 12 takes a trunk opening cancel position as shown in FIG. 9 after being turned through about 90° in the direction opposite to the direction of the arrow C from the locking position, the engaging protrusion 37 is not confronted with the end portion of the lever 34, thus permitting the rotation of the lever 34 in the direction opposite to the direction of the arrow D against the elastic force of the coil spring 36 about the shaft 35. A hooking part 34*a* of the lever 34 is hooked to a trunk opener releasing wire.

The operation of the cylinder lock thus constructed will be described.

In order to open the trunk lid with the key, the cover 4 on the body 1 is swung about the shaft 5 with the finger in the direction opposite to the direction of the arrow A. As a consequence, the engaging protrusions 9 and 29 are engaged with each other in such a manner that the engaging protrusion 9 rides the engaging protrusion 29. Therefore, even if the finger is removed from the cover 4, the cover is held open against the elastic force of the spring 8 as shown in FIG. 2. When the cover 4 is opened as described above, the lock element 10 is confronted with the engaging part 25 of the lock lever 26 as indicated by the two-dot chain line in FIG. 3.

Under this condition, when the key is inserted into the key hole 13 of the key rotor 12, the movement of the movable part 17 is stopped while the end portions of the lock plates 14 are disengaged from the lock groove 2*a*, thus enabling rotation of the key rotor in the rotor inserting hole 2. Therefore, when the key rotor 12 is turned in the direction of the arrow C with the key, the trunk locking device is released.

As the key rotor 12 is turned as described above, the protrusion 20 of the rotor cover 19 abuts against the releasing protrusion 22 of the cover 4 and finally the latter 22 rides the former 20. As a result, the cover 4 is slightly moved away from the front surface of the body 1 against the elastic force of the spring 8, and the engaging protrusion 9 is disengaged from the engaging protrusion 29. Accordingly, the cover 4 should be turned in the direction of the arrow A by the spring 8. However, the movement of the movable part 17 is stopped by the key, and the rotation of the lock lever 26 in the direction of the arrow E is prevented by the regulating part 27, and, therefore, when the cover 4 turns slightly in the direction of the arrow A the lock element 10 is engaged with the engaging part 25 of the lock lever. That is, the return of the cover in the direction of the arrow A is stopped, and the cover is maintained open.

The key inserted into the key hole 13 may be returned to the locking position as shown in FIGS. 2 and 3. When, under this condition, the key is removed from the key hole 13, the movable part 17 becomes movable in the recess 15, as a result of which the regulating part 27 of the lock lever 26 is released, and the lock lever 26 becomes movable in the direction of the arrow E.

Figure 8:
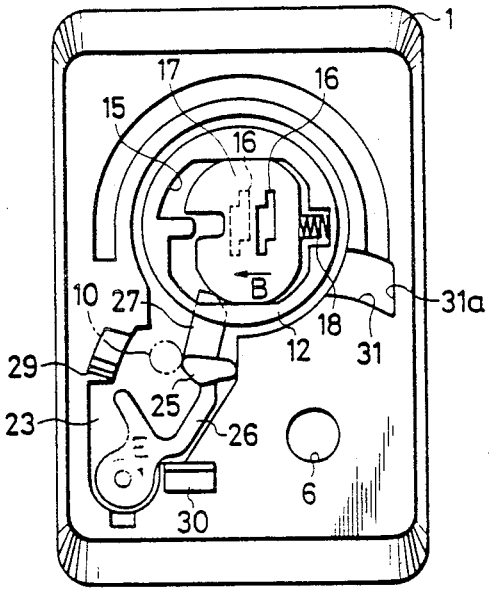
FIG. 8 is a different front view of the cylinder lock of FIG. 1 with the cover removed.

On the other hand, the cover 4 is urged in the direction of the arrow A by the spring 8, and the elastic force of the spring 8 acts on the lock element. Therefore, the elastic force acting on the lock element 10 turns the lock lever 26 in the direction of the arrow E, and the lock element 10 is disengaged from the engaging part 25 of the lock lever 26 (as shown in FIG. 8). The cover 4 is turned in the direction of the arrow A by the spring 8 so that it covers the front side of the body 1 as shown in FIG. 1.

When the lock lever 26 is turned in the direction of the arrow E to disengage the lock element 10 from the engaging part 25, the movable part 17 is moved by the regulating part 27 in the direction opposite to the direction of the arrow B against the elastic force of the spring 18. However, when the lock element 10 is disengaged from the locking part 25, the movable part 17 is returned to the original position by the elastic force of the spring 18. The key hole 13 is aligned with the through-hole 16 while the lock lever 26 is returned to the original position as shown in FIG. 3.

The operation of opening the trunk lid with the key has been described.

Now, an operation of opening the trunk lid with the trunk opener means instead of a key will be described. When the trunk opener lever near the operator's seat is operated with the key hole 13 of the key rotor 12 held at the locked position as shown in FIGS. 2, 3 and 5, the hooking part 34*a* of the lever 34 is moved in the direction of the arrow F by a trunk opener releasing wire (not shown). In this operation, the end of the lever 34 is abutted against the engaging protrusion 37 to prevent only the lever 34 from turning in the direction opposite to the direction of the arrow D, and therefore the lever 32 together with the lever 34*a* is moved in the direction of the arrow F, thus releasing the trunk locking means.

Next, an operation of making the trunk opener inoperative will be described.

As in the above-described operation, the cover 4 is opened by turning it with the finger in the direction opposite to the direction of the arrow A against the elastic force of the spring 8. This engages the engaging protrusion 9 with the engaging protrusion 29. Under this condition, the key is inserted through the through-hole 16 into the key hole 13, and is turned through 90° in the direction opposite to the direction of the arrow C. In this operation, the key rotor 12 together with the key is turned, as a result of which the releasing protrusion 22 of the cover 4 rides the protrusion 21 of the rotor cover 19. Accordingly, the cover 4 is slightly spaced from the front surface of the body 1, and the engaging protrusion 9 is disengaged from the engaging protrusion 29.

When the movement of the movable part 17 is stopped by the key, the lock element 10 is engaged with the engaging part 25 so that the cover 4 is further opened. When the key is removed after the key operation, the movable part 17 becomes movable and the lock lever 26 becomes rotatable in the direction of the arrow E. Therefore, the lock element 10 is disengaged from the engaging part 25 of the lock lever 26, and the cover 4 is returned by the elastic force of the spring 8, thus covering the front surface of the body 1.

When the key rotor 12 is turned as described above, the engaging protrusion 37 thereof is also turned so that it is not confronted with the end of the lever 34 as shown in FIG. 9. When, under this condition, the trunk opener lever located near the operator's seat is operated to cause the trunk opener releasing wire to move the hooking part 34*a* of the lever 34 in the direction of the arrow F, the lever 34 is turned about the shaft 35 in the direction opposite to the direction of the arrow D against the elastic force of the coil spring 36 (as indicated by the two-dot chain lines in FIG. 9). In this operation, as the lever 32 is not turned at all, the trunk remains locked, that is, the trunk opener is made inoperative.

As is apparent from the above description, the cylinder lock has the cover 4 on the front side of the body 1 to open and close the front side of the key rotor 12. In this cylinder lock upon removal of the key the cover 4 is returned with aid of the spring 8 to close the front surface of the body 1 when the key inserted into the key hole 13 of the key rotor 12 is turned in the direction of unlocking, i.e., in the direction of the arrow C. The trunk opener is made inoperative by turning the key in the direction of locking, i.e., in the direction opposite to the direction of the arrow C. Thus the invention is applicable to a mechanism for making a trunk opener inoperative.

As is apparent from the above description, in the cylinder lock with the cover adapted to cover the front side of the key rotor, the cover is automatically closed upon removal of the key from the rotor not only in the case where the key is turned in the direction of unlocking with the cover opened but also in the case where the key is turned in the direction opposite to the direction of unlocking.

It should be understood that the present invention is not limited to the particular embodiment described, but rather is susceptible to modifications, alterations, and equivalent arrangements within the scope of the appended claims.

What is claimed is:

1. A cylinder lock comprising:

a body including a rotatable key rotor;

a cover rotatable along the front surface of said body and rotatable between open and closed positions to respectively uncover and cover the front side of said key rotor;

a spring for urging said cover to the closed position;

a first engaging protrusion formed on said body and a second engaging protrusion formed on said cover such that when said cover is in said open position said first and second engaging protrusions engage each other to maintain said cover in said open position against the force of said spring;

a movable part having a key receiving opening and being movably provided on the front side of said key rotor, the movement of said movable part being prevented by insertion of a key in said key receiving opening;

a lock lever movably provided on said body, said lock lever including a regulating part for engaging said movable part when movement of said movable part is prevented by the insertion of a key in said key receiving opening;

a releasing member adapted to move said cover to said open position and away from the front surface of said body to disengage said first and second engaging protrusions from each other when a key inserted in said key receiving opening is turned in a predetermined direction; and a lock element formed on said cover, said lock element for engaging said lock lever when said first and second engaging protrusions are disengage from each other by said releasing member responsive to the turning of said key in said key receiving opening in said predetermined direction, the engagement of said lock lever and said lock element maintaining said cover in said open position and out of engagement with said key inserted into said key receiving opening until said key is removed from said key receiving opening to permit movement of said movable part to disengage said regulating part from said movable part, the movement of said lock lever out of engagement with said lock element, and rotation of said cover to said closed position.

* * * * *